United States Patent [19]

Hettinger, Jr. et al.

[11] Patent Number: 4,816,195

[45] Date of Patent: Mar. 28, 1989

[54] PROCESS OF MAKING A LOOSELY FORMED NON-WOVEN MAT OF ALIGNED CARBON FIBERS

[75] Inventors: William P. Hettinger, Jr., Russell, Ky.; Larry D. Veneziano, Sima, Calif.

[73] Assignee: Ashland Oil, Inc., Ashland, Ky.

[21] Appl. No.: 941,895

[22] Filed: Dec. 15, 1986

Related U.S. Application Data

[63] Continuation of Ser. No. 760,809, Jul. 30, 1985, abandoned.

[51] Int. Cl.[4] ..... D01F 11/10

[52] U.S. Cl. ..... 264/29.2; 242/118.1; 242/118.32; 264/518; 264/82; 264/211.11; 264/211.15; 264/211.17; 423/447.1; 423/447.2; 423/447.6

[58] Field of Search ..... 264/121, 517, 518, 29.2, 264/108.29.1, 82, 211.11, 211.15, 211.17; 156/167; 162/108; 57/362; 242/55.1, 62, 174, 118.1, 118.32; 423/447.1, 447.2, 447.4, 447.6

[56] References Cited

U.S. PATENT DOCUMENTS

| | | | |
|---|---|---|---|
| 3,615,995 | 10/1971 | Buntin et al. | 156/167 |
| 3,684,415 | 8/1972 | Buntin et al. | 156/167 |
| 3,755,527 | 8/1973 | Veller et al. | 264/121 |
| 3,870,567 | 3/1975 | Palme et al. | 264/121 |
| 3,947,535 | 3/1976 | Bogg et al. | 264/517 |
| 3,978,185 | 8/1976 | Buntin et al. | 264/121 |
| 4,267,002 | 5/1981 | Sloan et al. | 264/518 |
| 4,340,563 | 7/1982 | Appel et al. | 264/518 |
| 4,371,129 | 2/1983 | Schulz | 242/118.32 |
| 4,442,062 | 4/1984 | Fujii et al. | 264/518 |
| 4,496,508 | 1/1985 | Hartmann et al. | 264/518 |
| 4,526,733 | 7/1985 | Lau | 264/518 |
| 4,527,754 | 7/1985 | Flynn | 242/118.1 |
| 4,576,810 | 3/1986 | Redick | 242/118.1 |

FOREIGN PATENT DOCUMENTS 1177605 11/1984 Canada .

*Primary Examiner*—Jan H. Silbaugh
*Assistant Examiner*—Hubert C. Lorin
*Attorney, Agent, or Firm*—Richard C. Willson, Jr.; Donald E. Zinn

[57] ABSTRACT

A large number of melt blown carbon fibers from petroleum pitch through a multi-orifice die under continuous formation, are fed onto the periphery of a continuously moving endless conveyor surface whose surface speed is matched to the linear velocity of the melt blown carbon fibers to cause the fibers to be deposited in parallel alignment on the conveyor surface and to be maintained in fiber axial alignment to form a non-woven mat of aligned carbon fibers. The speed of the conveyor surface may be slightly less than the linear speed of the fibers to form a loose fiber mat to facilitate subsequent fiber oxidation and carbonization by permitting gas flow through the aligned fiber mat. The endless conveyor may comprise a cylindrical drum whose surface is perforated to facilitate gas flow and oxidation of the carbon fibers subsequent to non-woven mat formation. The drum circumference may be set to the desired fiber length and the mat severed transversely to permit removal of the aligned fibers of desired length in bundle form.

2 Claims, 2 Drawing Sheets

FIG. 2
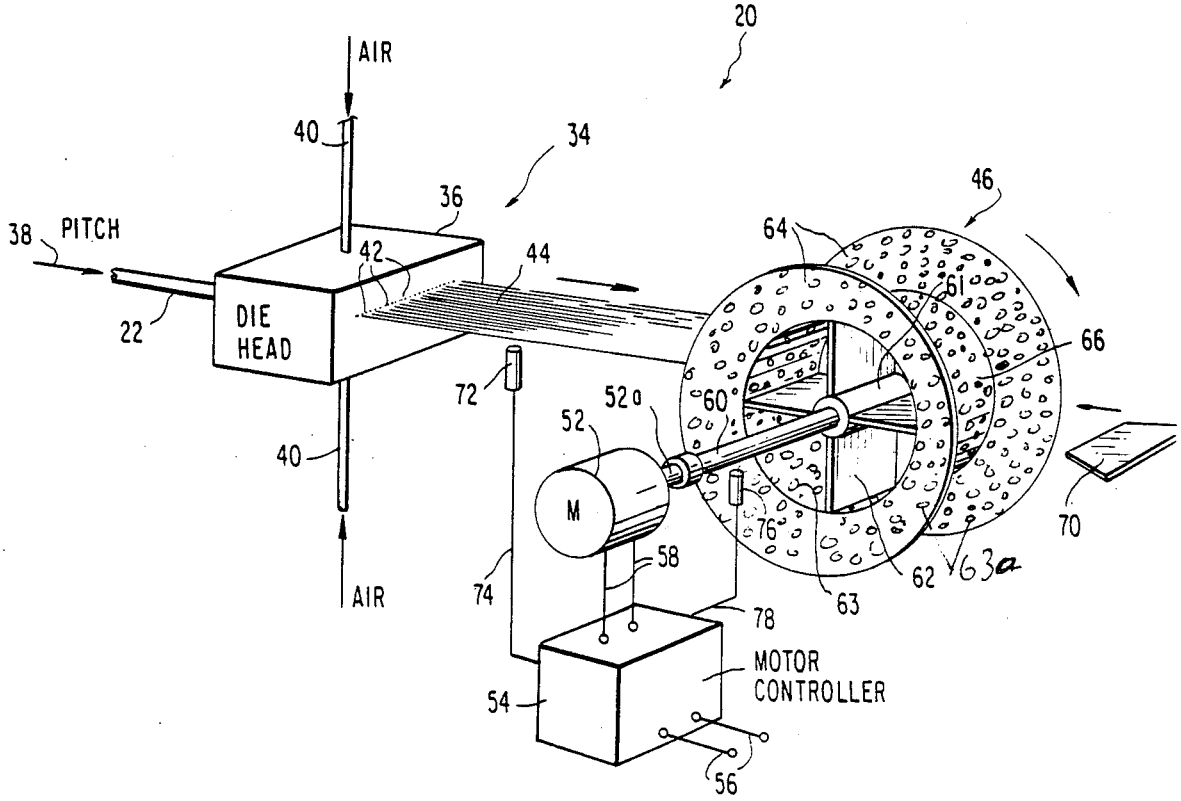
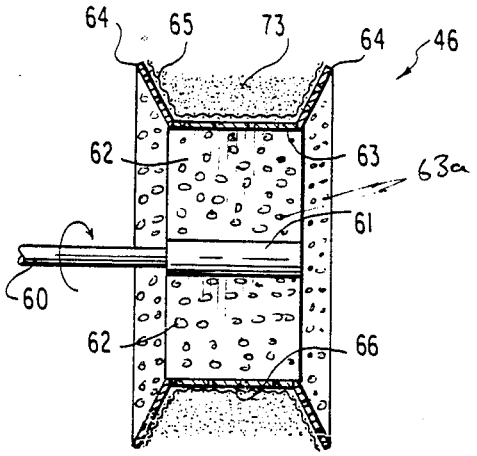
FIG. 3

PROCESS OF MAKING A LOOSELY FORMED NON-WOVEN MAT OF ALIGNED CARBON FIBERS

This application is a continuation of application Ser. No. 760,809, filed, July 30, 1985, now abandoned.

FIELD OF THE INVENTION

This invention relates to a process for manufacture of carbon fibers and more particularly to a process for effecting the formation of non-woven mats of aligned carbon fibers in a manner facilitating subsequent oxidation and carbonization of the aligned fibers.

BACKGROUND OF THE INVENTION

Carbon and graphite fibers and composites made therefrom are increasingly used in the manufacture of components for lightweight aircraft, aerospace structures, automobile parts, and sporting equipment. Carbonaceous material is melted, spun into thread or filament form, and converted to a carbon or graphite fiber. The spun filament or filaments are stabilized, i.e. rendered infusible through a heat treatment in an oxidizing atmosphere, and thereafter heated to a higher temperature in an inert atmosphere to convert the filament into a carbon or graphite fiber.

A significantly large percentage of commercial carbon fiber processes employ mesophase pitch as the source of the carbon or graphite fiber. The high cost of the graphite fibers so produced is due primarily to the cost of producing the mesophase pitch as the base of such fiber manufacture. Further, most of the commercial fibers produced from mesophase pitch has been fibers which have been subsequently converted to graphite fibers. Because the temperature of graphitization is higher than the temperature required to produce a carbon fiber, graphite fibers are much more costly to produce than carbon fibers. Attempts have been made to manufacture carbon fibers from pitch materials without converting the pitch into the mesophase state.

Canadian Pat. No. 1,177,605 issued Nov. 12, 1984, to the common corporate assignee, is directed to the production of non-mesophasic aromatic enriched pitches which can be quickly processed into carbon fibers at a much lower cost having excellent intermediate properties, permitting them to be used in many applications where asbestos is being currently used. As a result thereof, such carbon fibers can be employed in the manufacture of brake drums and discs, particularly useful in the automotive field. Such fibers also constitute an excellent replacement for asbestos fiber.

Referring to FIG. 1, there is shown a flow diagram covering the process for the manufacture of carbon fibers from non-mesophase pitch as exemplified by Canadian Pat. No. 1,177,605 and to which process the present invention has application. In order to appreciate the content of the present invention as directed to improvements in the formation of the carbon fibers and their subsequent stabilization and carbonization and for facilitating the stabilizing and carbonizing process steps, a brief review of the nature of manufacture of pitch carbon fibers from FIG. 1 is necessary. The content of Canadian Pat. No. 1,177,605 is incorporated by specific reference herein. The starting petroleum pitch utilized in the process of this invention, as in the case of Canadian Pat. No. 1,177,605, may be an aromatic base, unoxidized carbonaceous pitch produced from heavy slurry oil produced in the catalytic cracking of petroleum distillates. As such, in FIG. 1, block 10 represents the fluid catalytic cracker, and the slurry oil produced in the catalytic cracking of petroleum distillates is fed through closed pipeline 12 to a pitch unit 14 for further cracking and processing producing a type of pitch under the Ashland Oil, Inc., designation A-240, which is supplied to the wiped-film evaporator 18 via closed pipeline 16. Such pitch is a commercially available unoxidized petroleum pitch meeting the requirements of the low cost production of non-mesophase pitch carbon fiber. The term "non-mesophase" is meant to means less than 5% by weight of mesophase pitch. Such a pitch is generally referred to in the art as an isotropic pitch, e.g. a pitch exhibiting physical properties such as light transmission with the same values when measured along axes in all directions. In a process of the referred to Canadian patent, the wiped film evaporator is used to reduce the time of thermal exposure of the product, thus producing a better fiber precursor. The evaporator 18 may be of the type manufactured by Artisan Industries, Inc. of Waltham, Massachusetts and sold under the trademark Rothotherm. In such a wiped-film evaporator, the feed, i.e. the A-240 pitch material, enters the unit and is thrown by centrifugal force against the heated evaporator walls to form the turbulent film between the wall and rotor blade tips. The turbulent flowing film covers the entire wall, regardless of the evaporation rate. The material is exposed to high temperature for only a few seconds. Briefly, as described in the Canadian patent, A-240 pitch material is melted in a melt tank after being filtered to remove contaminants including catalyst fines. It is pumped through a back pressure valve into the wiped-film evaporator 18. In turn, the wiped-film evaporator is heated by hot oil contained in a reservoir which is pumped into the thin film evaporator through a supply line. As the A-240 pitch material is treated in the thin film evaporator, vapors escape the evaporator and are condensed in first and second condensers. The vapors then pass through a conduit into a cold trap and out through a line with vacuum being applied to the system via a vacuum pump. Under these conditions, feed rates of between 15 to 20 pounds of A-240 pitch per hour are utilized which produce about 10 pounds per hour of a higher softening point pitch, in turn, supplied by the wiped-film evaporator 18 to the fiber forming apparatus indicated at 20 via a further closed pipeline 22. Preferably, the fiber forming apparatus 20 is a melt blowing extruder of the type disclosed in U.S. Pat. Nos. 3,615,995 and 3,684,415 to Buntin. The melt blowing extruder operates such that the high softening point pitch fed thereto is extruded through a large number of orifices of suitable diameter into a moving stream of hot inert gas which issues from outlets surrounding or adjacent to the orifices so as to attenuate the molten material into fibers which form a fiber stream. The hot inert gas stream flows at a linear velocity parallel to and higher than the filaments issuing from the orifices, so that the filaments are drawn by the gas stream, entrained therein and moved therewith. The fibers in the process of Canadian Pat. No. 1,177,605 are collected on a receiver in the path of the fiber stream to form a non-woven mat. Arrow 22 from the fiber forming block or apparatus 20 of the flow diagram represents the receiver. The fibers borne by the receiver (or the fibers after removal from the receiver), are then subjected to stabilization within an enclosed stabilizer 24.

The fibers made from the pitch are successfully stabilized in air by subjecting the fibers to a special heat cycle. As set forth within Canadian Pat. No. 1,177,605, the stabilization process is effected in less than 100 minutes, with the 100 minute cycle consisting of holding the pitch fibers at approximately 11° C. (20° F.) below the glass transition temperature (Tg) of the precursor pitch i.e. about 180° C. (356° F.) for about 50 minutes. This is followerd by an increase to about 200° C. (392° F.) and holding 30 minutes at that temperature. The temperature is then increased to about 265° C. (509° F.) and the fibers held 10 minutes. Finally, the fibers are heated to about 305° C. (581° F.) and held 10 minutes at this temperature.

Thereafter, the fibers in non-woven mat form, either on the receiver or removed from the receiver, are then subjected to a carbonizing process in a carbonizer, as evidenced in block form at 28 in the flow diagram of FIG. 1. This may be a separate enclosure 28, as in FIG. 1, or the stabilizer enclosure 24, subjected to different operating parameters. The transfer is schematically shown by arrow 26 in FIG. 1. The carbonization step involves a modification of the physical properties of the fibers after further heating to about 1100° C. (2000° F.) in an inert atmosphere such as nitrogen for several hours (two hours) in order to convert them to carbon fibers. Subsequently, they are removed and given final product packaging as exemplified by block 32 with the removal step being shown by arrow 30.

It should be kept in mind that the term "oxidizing" environment means either subjecting the fibers to an oxidizing atmosphere or impregnating an oxidizing material within or on the surface of the individual fibers. An oxidizing atmosphere may consist of a gas such as air, enriched air, oxygen, ozone, nitrogen oxide, sulfur oxide, etc. The impregnated oxidizing material can be one of any of a number of oxidizing agents such as sulfur, nitrogen oxides, sulfur oxides, peroxides, persulfates, etc. Stabilization of fibers made from other high softening point pitches, such as an A-410-VR pitch, involves similar heating cycles for an extended period of time, i.e. 36 hours, with similar step increases in temperature. It should be kept in mind that if either temperature is exceeded or time shortened, the fibers begin to melt and fuse during subsequent processing.

In the process of Canadian Pat. No. 1,177,605, it was found that air stabilization is much more effective where the fibers are first heated to a temperature of about 6° to 11° C. (10° to 20° F.) below the glass transition temperature of the pitch precursor and thereafter, after a period of time of approximately 50 minutes, heated to a temperature within the range of 299°–316° C. (570° to 600° F.) until stabilization is reached. The glass transition point represents the temperature of Young's modulus change and is also the temperature at which the glassy material undergoes a change in coefficient of expansion which is often associated with a stress release. At 6° to 11° C. below the glass transition temperature, the fibers maintain their stiffness while at the same time the temperature represents the highest temperature allowable for satisfactory stabilization to occur. This temperature is below the point at which fiber-fiber fusion can occur. After the fiber has been heated at this temperature for a sufficient time to form a skin, the temperature can be raised at a rate such that the increased temperature is below the glass transition temperature of the oxidized fibers, protected against fusion by the skin. It was further discovered that during the oxidation of the carbon fibers, a glass transition temperature increases and by maintaining the temperature during heat up at a point 6° C. below the glass transition temperature, undesired slumping of the fibers does not occur. As the temperature is increased, the oxidation rate increases and conversely the stabilization time decreases.

While the process as set forth in Canadian Pat. No. 1,177,605 produces petroleum pitch based carbon fibers in which the fibers are prepared by melt blowing, and wherein the fibers are collected on a receiver positioned in the path of the air blow fibers to create a non-woven mat, in the manner of the U.S. Pat. Nos. 3,615,995 and 3,684,415 to Buntin, the resultant non-woven mat creates an end product which is undesirable and has limited utility.

By melt blowing, the individual fibers are not only reduced in diameter, but accelerated to velocities in terms of hundreds of miles per hour. Buntin collects the fibers in an effort to form a relatively thick mat. As such, the fibers are non-aligned, and the mat is achieved by slowly rotating a small diameter cylinder or wheel over a limited arc. The result of this is that the fibers impinge the periphery of the cylinder at 100 miles per hour or so, while the wheel is turning such that its periphery moves approximately one foot per minute, i.e. 60 feet per hour. As a result, there are hundreds of miles of multiple fibers piled up in 60 feet. As a result, Buntin creates a mat of non-aligned thermoplastic polymer fibers, as the wheel continues to turn, with the piled fiber mat being pulled off after the fiber mat moves approximately ¼ of a rotation in contact with the screen drum upon which the fibers impinge. As may be appreciated, this has the net result of frustrating both the stabilization and carbonization processes required of the carbon fibers and the creation of a non-woven fiber mat comprised of aligned fibers.

OBJECTS OF THE INVENTION

It is, therefore, a primary object of the present invention to provide a process particularly applicable to the production of non-mesophase pitch carbon fibers by melt blowing in which the fibers are maintained in parallel alignment to produce a non-woven mat of aligned carbon fibers and in which stabilization and carbonization of the aligned carbon fibers are facilitated.

It is a further object of the present invention to provide an improved melt blowing carbon fiber manufacturing process in which a non-woven aligned fiber mat maintains the fibers aligned during stabilization and carbonization, and wherein such aligned fiber non-woven mat may be subsequently unwound to provide a continuous, stabilized and carbonized carbon fiber which may be readily converted into thread or yarn and which, in turn, can be woven into cloth or in bulk form aligned in a single direction.

It is a further object of the present invention to provide an improved process of melt blowing aligned carbon fibers which may be readily concentrated in aligned bundles of predetermined length to facilitate the formation of an aligned fiber composite equal in length to the bundle of fibers.

SUMMARY OF THE INVENTION

The present invention is directed to an improved process for manufacturing carbon fibers rendered infusible and thereafter carbonizing the fibers. The improvement comprises the feeding of the continuous fibers as they are melt blown in parallel alignment onto the periphery of a continuously moving endless conveyor surface operating at a linear surface speed generally equal to the velocity of the fibers as they are deposited on the endless conveyor surface and to thereby retain the fibers in fiber axial alignment and to form a non-woven mat of continuous, aligned carbon fibers.

In the process, the linear velocity of the endless conveyor surface may be maintained slightly below that of the linear velocity of the aligned fibers contacting the endless conveyor surface such that the fibers remain aligned within the non-woven mat but the mat is loosely formed to facilitate passage of gas therethrough for subsequent oxidation and carbonization of the fibers. The endless conveyor surface may comprise a perforated surface to facilitate gas passage through the periphery of the continuously moving endless conveyor surface, permitting the aligned fibers to be maintained on the perforated conveyor surface during stabilization and/or carbonization thereof. The circumference of the continuously moving endless conveyor surface may be of a preset dimension correlated to the desired length of a fiber bundle formed by the fiber mat, and wherein transverse severance of the mat permits the creation of a bundle of aligned fibers of a length corresponding to the circumference of the moving endless conveyor surface.

BRIEF DESCRIPTION OF THE DRAWINGS

FIG. 2 is a schematic perspective representation of a modified melt blowing apparatus effecting the formation of a non-woven carbon fiber mat of aligned fibers and facilitating the subsequent stabilization and carbonization of the petroleum pitch carbon fibers and forming a preferred embodiment of the present invention.

FIG. 3 is a transverse section view of the rotating drum forming a principal component of the apparatus of FIG. 2.

DESCRIPTION OF THE PREFERRED EMBODIMENT

Figure 1:
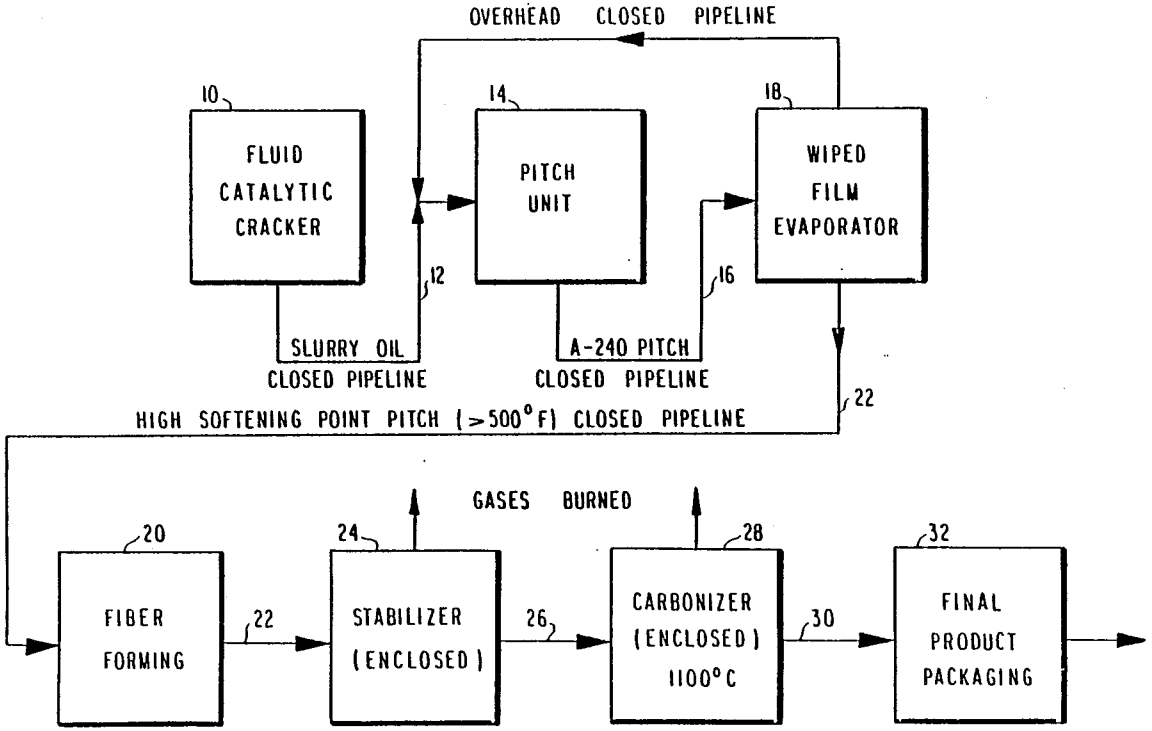
FIG. 1 (PRIOR ART)
FIG. 1 is a flow diagram of the process of manufacture of carbon fibers from petroleum pitch to which the present invention has application.

The present invention has application to the process for manufacturing carbon fibers as set forth in Canadian Pat. No. 1,177,605 and as represented by the schematic diagram of FIG. 2. In that respect, it deals with the fiber forming, stabilization and carbonizing process steps as depicted by blocks 20, 24, and 28, respectively, in FIG. 1.

FIG. 2, depicts a schematic representation of the nature in which tens, hundreds or even thousands of melt blown fibers are centered and maintained in parallel alignment, and are caused to adhere to the periphery of a rotating reel which rotates at a speed such that its peripheral linear surface velocity matches approximately the linear velocity of the fibers at their initial point of contact with the wheel periphery to create a non-woven mat of aligned or semi-aligned fibers to facilitate stabilization and carbonization of the fibers subsequent to fiber formation and deposit thereon.

In the manner of Canadian Pat. No. 1,177,605, the pitch material and its process of forming to which the present invention has application, may be A-240 pitch supplied by pitch unit 14, FIG. 1, through pipeline 16 and treated within the wiped-film evaporator 18 to produce the higher softening point pitch via exiting therefrom pipeline 22. This increased softening point pitch may be a pitch under designation A-410-VR or designation AR-510-TF and manufactured in accordance with examples of Table IV and Table V(B) as set forth within Canadian Pat. No. 1,177,605. Without further processing, this increased softening point pitch is fed to the melt blowing extruder indicated generally at 34, FIG. 2, via closed pipeline 22 and specifically to die head 36 of that extruder. The high softening point pitch, identified at arrow 38, is extruded through a plurality of orifices 42, lying in a common horizontal plane, and being laterally spaced from each other, within die head 36. Extrusion occurs under application of high pressure inert gas or air supplied thereto, through lines 40, leading to the die head 36 from opposed faces. The hot inert gas stream flows at a linear velocity parallel to and higher than the filaments or fibers 44 issuing from orifices 42, so that the fibers 44 are drawn by the exiting gas stream. The fibers 44 are attenuated at the die head 36 by having air or an inert gas impinge upon the fibers at the extrudate point, i.e. orifices 42. The air or inert gas reduces the fiber diameters from approximately 250 microns down to 5–10 microns for typical orifice diameters. The air is the main contributor to the fiber velocity as the fiber leaves the die head 36. Typically, such fiber velocities are on the order of 1,000 to 1,200 feet per minute. The present invention utilizes a rotating drum or reel indicated generally at 46 mounted for rotation about its axis on shaft 60 and positioned in the path of fibers 44 at right angles thereto to produce a non-woven, aligned fiber mat. The periphery of the drum 46 is required to rotate at generally the same linear velocity as that of the fibers 44 contacting the surface 66 of the drum. The drum 46 is driven by variable speed electric motor 52 with the drum shaft 60 engaging directly axially aligned output shaft 52*a* of the motor 52 for rotation about the motor shaft axes and that of drum 46. A motor 52 is driven from a source of electrical power (not shown) via leads 56 which connect to motor controller 54. The motor controller 54, which may be a microprocessor, is connected to the motor 52 via leads 58.

In the illustrated embodiment, the air flow rates of the air exiting orifices 42 and accelerating the filaments or fibers 44 captured in the air stream is approximately 12 SCFM. In the illustrated embodiment, the periphery 66 of drum 46 is positioned approximately 24 inches away from the orifice 42 of the die head 36. In turn, drum 46 may taken the form of a reel, being comprised of a hub 61 mounted to shaft 60 with a plurality of spokes 62 extending radially from the hub 61 and fixed at their outboard ends to a rim 63. To rim 63 are mounted to each side thereof, radially outwardly inclined strips 64. Wire mesh screening, as at 65, of U-shaped configuration supported at the bottom by rim 63, and at the sides thereof by strips 64, captures the fibers as they contact the periphery 66 of the drum 46. Rim 63 may be formed of wire mesh screening or, as shown, a perforated strip may constitute the rim. The perforations within the rim permit passage of gas therethrough. Under such conditions, it is possible to complete the stabilization and carbonization of the carbon fibers by removing the drum 46 with the aligned fiber non-woven mat maintained on the drum 46 and the drum 46 physically positioned sequentially, within the enclosed stabilizer and the enclosed carbonizer. In the illustrated embodiment, the reel diameter at its periphery 66 is 17 inches, and the lateral width of rim 63 upon which the fibers are deposited is 9 inches.

Mats produced under these conditions are very dense and compact with fiber count ranging from 550 to 2,200. The length of the mat formed on the basis of the rim diameter of 17 inches is 2.1 feet and constant since the diameter of the drum or reel is unchanged. The fibers are sufficiently flexible so that by subjecting the aligned fiber non-woven mat to a knife blade severance, by severing the mat transversely thereof by guillotine knife blade 70 being forcibly moved into contact with the rim 63 of the drum 46 and through the mat 73, a bundle of aligned fibers 2.1 feet in length may be physically removed from drum 46 after termination of rotation thereof.

The microprocessor 54 comprises a comparator which compares two input signals, one emanating from a first sensor 72 and fed to the microprocessor 54 via line 74. Sensor 72 senses the velocity of the fibers passage from orifices 42 of the die head 36 to the periphery 66 of the drum or rotating reel 46.

A second sensor 76 senses the rpm of shaft 60 and feeds an appropriate electrical input signal through line 78 to microprocessor 54. Typically, the sensor 76 may comprise a magnetic or optical sensor for producing electrical pulses response to the rpm of shaft 61 of motor 52 and thus, under a direct or indirect drive system, the rpm of the drum or reel 46. With the speed of the drum or reel 46 matching the velocity of the extruded fibers 44, an aligned fiber mat is produced. The fiber count in the mat is variable and dependent upon the number of revolutions the drum is allowed to take before the drum rotation is terminated. The mat may be severed using guillotine knife blade 70 or the like and the severed mat then removed from the periphery 66 of the drum. The mat length is dependent upon drum diameter, and the mat length corresponds to the linear distance of the circumference of the drum periphery 66 upon which the fibers are deposited to form the non-woven mat.

Since motor 52 is a variable speed motor, operating under microprocessor control via control signals through leads 58, the present invention additionally contemplates varying the control signal slightly to slow the rotational speed of the drum relative of the velocity of the fibers 44 impinging on the drum periphery 66. By reducing the speed of the drum 46 slightly and maintaining the fiber velocity the same, the production of a loose weave, non-woven aligned fiber mat is achieved which facilitates the passage of stabilizing oxygen therethrough when the mat is subject to stabilization and additionally facilitates the carbonization of the fibers after stabilizing. Increasing the relative velocity of the drum with respect to the fibers may result in stretching of the fibers and the formation of a dense, compact aligned fiber mat. Typically, mats produced under the process of the present invention are from 0.5 to 2 inches in thickness.

As may be appreciated, by laying up the multiple fibers in aligned, parallel axial orientation, there results maximum strength and maximum concentration of fibers in the non-woven aligned fiber matrix. Typically, in the manufacture of a strong golf club shank, for instance, the carbon fibers are lined up in a single direction and glued together to form a composite shaft. Additionally, under other circumstances, it is preferred to untangle and remove the fibers separately form the reel subsequent to stabilization and carbonization allowing the fibers which can be converted into thread or yarn which, in turn, can be woven into cloth or in bulk firm aligned in a singular direction.

Once a mat in roll form reaches the desired thickness on the reel periphery 66, the apparatus is stopped, the reel is disconnected from motor shaft 61, a new reel is coupled to the motor shaft, and the aligned fiber bundle may be cut off the reel after reel removal. In the illustrated embodiment, the guillotine knife blade 70 is shown as movable into contact with the mat 73, and the aligned fiber bundle is formed by severing the mat 73 transversely at one point about the circumference of the reel or drum 46. Typically, as in the illustrated embodiment, some 600 fibers may issue continuously from the die head 36 with the orifices extending across the die head 36 over an extent of 20 inches.

Alternatively, by placement of the reel into a programmed oven, as for instance the enclosed stabilizer 24, and subjecting the non-woven relatively thick aligned fiber mat to increased temperature, fiber stabilization is achieved by forcing air through that relatively thick mat. By utilizing the loose wind technique of the present invention, the stabilization rate increases measurably. Otherwise, if stabilization takes a significantly long period, an excessive temperature rise occurs because heat is generated during the stabilization process. By providing perforations on the inside rim 66 of the reel or drum 46, or by using screen as rim material, the flow of air or oxygen under pressure through the relatively thick layer mat is facilitated with a gradual raising of temperature within the oven or enclosed stabilizer 24, thereby producing effective and quick stabilization of the fibers. It is particularly necessary under most circumstances to maintain the fiber mat wrapped to the periphery 66 of the drum or reel 46 until stabilization is completed.

The stabilization creates a surface film on the outside of the fibers, thereby preventing coalescence between fibers. Therefore, subsequent to stabilization, the fibers may be individually unwrapped to produce very long, continuous fibers. Alternatively, the wrap may be severed transversely and the bundle laid open, like a long bundle of straw.

It must be additionally appreciated that the formation of individual fibers from pitch which can then be spun is well established commercially. However, when fibers are melted under the melt blowing processes conventionally fibers other than carbon fibers formed of a liquid hydrocarbon feed stock, the handling of such fibers is extremely delicate since the fibers are very brittle before they are stabilized and carbonized. Due to the acceleration of the fibers to hundreds of miles per hour velocity, the fibers other than in the process of this invention are required to pass through very long ovens, back and forth, back and forth, before they are stabilized, and frequently the fibers break. The use of spinning techniques normally employed on nylon or other synthetic fibers is not only difficult, but requires placement of the fibers under tension. This is extremely expensive, and while adapted to making high performance fibers, cannot be employed economically to make a cheap asbestos replacement fiber to which the present invention has high utility. In contrast to high performance graphite fibers, which may cost $20.00 to $30.00 a pound, the carbon fibers manufactured in accordance with the processes of this invention will sell for perhaps one-third that amount. The present invention, therefore, provides an inexpensive, high volume, low cost operation spinning and wherein the aligned fibers may be used in non-woven mat form as an aligned fiber bundle capable of immediately forming an aligned fiber composite. Such aligned fiber non-woven mats have application to the manufacture of carbon fiber brake pads and drums, thermal insulation, fuel cell electrodes, and the like. Assuming that the end product is to be a baseball bat, a bundle three inches in diameter of aligned carbon fibers may be prepared on a drum whose circumference matches the desired length of the bat. After the formation of a cylindrical mat of three inches in thickness of aligned non-woven fibers, the mat may be severed transversely, stabilized and carbonized with the stabilization and carbonization preceding or subsequent to severance of the mat from the reel. When cooled down, all of the fibers are aligned the length of the baseball bat perform, and the bat is formed by binding the fibers together and placing them in a press together with suitable binder. When subjected to heat, under pressure, the end product is a baseball bat in which all of the fibers run in the same direction parallel to the bat axis.

While the invention has been particularly shown and described with reference to a preferred embodiment thereof, it will be understood by those skilled in the art that various changes in form and details may be made therein without departing from the spirit and scope of the invention. Contents of all references and citations therein are hereby incorporated by reference.

What is claimed is:

1. In a process for manufacturing a non-woven mat of carbon fibers including:

melt blowing a petroleum pitch from a multi-orifice die to create a large number of continuous aligned carbon fibers, heating said fibers in an oxidizing environment to produce a skin effect thereon the render the fibers infusible, and thereafter carbonizing said fibers, the improvement comprising:

feeding said carbon fibers as they are melt blown in parallel alignment onto the periphery of a continuously moving endless conveyor surface, and driving said continuously moving endless conveyor surface at a linear speed generally equal to that of said fibers as blown from said die at the point of fiber impingement with the periphery of said continuously moving endless conveyor surface and in rotation over a number of revolutions of said endless conveyor surface, such that said fibers are deposited in parallel aligned overlapping fashion and retained in parallel alignment on said conveyor surface to form a non-woven mat of aligned overlapped carbon fibers, and wherein said driving said continuously moving endless conveyor surface comprises maintaining said speed of said continuously moving endless conveyor surface at a linear velocity slightly below the linear velocity of the fibers at the point of impact with the endless conveyor surface such that the fibers remain aligned in forming said non-woven mat, but said non-woven mat is loosely formed to facilitate subsequent oxidation and carbonization of the carbon fibers.

2. The process as claimed in claim 1, wherein said heating said fibers in an oxidizing environment to render the fibers infusible and thereafter carbonizing said non-woven comprises maintaining said fiber mat in contact with said endless conveyor surface in continuous fiber overlapped condition, and placing said non-woven mat borne by said conveyor surface within said at least said oxidizing environment to render said fibers infusible prior to removing of the non-woven mat from said endless conveyor surface.

* * * * *